US009373881B2

(12) United States Patent
Thompson, Jr. et al.

(10) Patent No.: US 9,373,881 B2
(45) Date of Patent: Jun. 21, 2016

(54) LOW RADAR CROSS SECTION ARRAY PANEL

(75) Inventors: Basil W. Thompson, Jr., Hooksett, NH (US); Robert D. Smith, Chelmsford, MA (US); Almer M. Garnett, Hudson, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 609 days.

(21) Appl. No.: 13/569,754

(22) Filed: Aug. 8, 2012

(65) Prior Publication Data

US 2014/0059840 A1 Mar. 6, 2014

Related U.S. Application Data

(60) Provisional application No. 61/522,754, filed on Aug. 12, 2011.

(51) Int. Cl.

| | |
|---|---|
| ***H01Q 1/12*** | (2006.01) |
| ***H01Q 21/06*** | (2006.01) |
| ***H01Q 1/14*** | (2006.01) |

(52) U.S. Cl.

CPC ..... *H01Q 1/14* (2013.01); *H01Q 21/061* (2013.01); *Y10T 29/49016* (2015.01)

(58) Field of Classification Search

CPC ..... H01Q 21/061; H01Q 21/064; H01Q 21/0025; H01Q 1/12; H01Q 1/1207; H01Q 1/20; H01Q 21/087; H01Q 13/085; Y10T 29/49016

See application file for complete search history.

(56) References Cited

U.S. PATENT DOCUMENTS 5,309,165 A * 5/1994 Segal et al. ..... 343/770
6,850,204 B1 * 2/2005 Angelucci ..... 343/770

OTHER PUBLICATIONS

Anping Yaozhong Metal Wire Mesh Factory, May 15, 2009 https://web.archive.org/web/20090515110101/http://www.bestwiremesh.com/.*

* cited by examiner

*Primary Examiner* — Livius R Cazan
(74) *Attorney, Agent, or Firm* — Sand & Sebolt, LPA; Scott J. Asmus; Daniel J. Long

(57) ABSTRACT

A low RCS array panel employs a number of linkable support segments. Each support segment has several junctions spaced along it, and the support segments are designed to connect with each other at the junctions to create a support grid. The segments can connect orthogonally, and the junctions can be spaced according to the frequency performance requirements for the antenna the array panel is designed to support.

16 Claims, 6 Drawing Sheets

LOW RADAR CROSS SECTION ARRAY PANEL

RELATED APPLICATIONS

This Application claims rights under 35 USC §119(e) from U.S. Provisional Application Ser. No. 61/522,754 filed Aug. 12, 2011, the contents of which are incorporate herein by reference.

STATEMENT OF GOVERNMENT INTEREST

The invention was made with United States Government assistance under contract No. FA86290-06-G-4028-0008 awarded by the US Air Force. The United States Government has certain rights in the invention.

FIELD OF THE INVENTION

The present invention relates to antenna support panels, and more particularly to low weight and low reflective antenna array support panels.

BACKGROUND OF THE INVENTION

When supporting antenna elements in an array, element size and frequency range dictate the weight for the antenna array support. Typical array panels provide a ground plane that forms a large reflecting surface, causing undesirable radar reflection and a large Radar Cross Section (RCS). Planar array supports offer support for the element weight and create a ground plane with a large RCS, even for elements that may not require a ground plane. Particularly in the battlefield, a large RCS is a large detriment and can be extremely dangerous. A need therefore exists for an antenna array panel that provides consistent array geometry support while limiting weight and RCS.

SUMMARY OF INVENTION

In order to solve the above problems, a low RCS array support panel includes a grid or lattice composed of a number of overlying support segments, with overlying support segments having junctions spaced along the support segments. In order to form the lattice, in one embodiment the overlying support segments are each designed to connect with each other at the junctions and may be secured by welding and the like. In one embodiment support plates are provided at the junction and are used to mount the antenna elements.

According to one embodiment, the support segments are designed to connect orthogonally at the junctions. In another embodiment, the support segments are made of mirror image wire segments joined together along their lengths except at the junctions where they are opened to receive a support plate. In a further embodiment the support segments are made of non-metal members such as overlying plastic ribs. In another embodiment, the junctions are placed along the support segments according to the frequency requirements of the antenna array that will be supported by the array support panel.

More particularly, the low RCS array support panel in one embodiment, offers support for elements that do not require a ground plane, while reducing the RCS for the overall array, and at the same time providing a lower assembly weight. The low RCS array support panel permits the formation of antenna arrays of varying sizes with minimal reflecting surfaces. The low RCS array support panel in one embodiment provides support for antenna elements by using an easily assembled adjustable design. The array support panel also implements convenient pre-formed methods of construction so that antenna arrays may be fabricated and supported with a low RCS grid or lattice.

BRIEF DESCRIPTION OF THE DRAWINGS

These and other features of the subject invention will be better understood in connection with the Detailed Description, in conjunction with the Drawings, of which.

DETAILED DESCRIPTION

Figure 1:
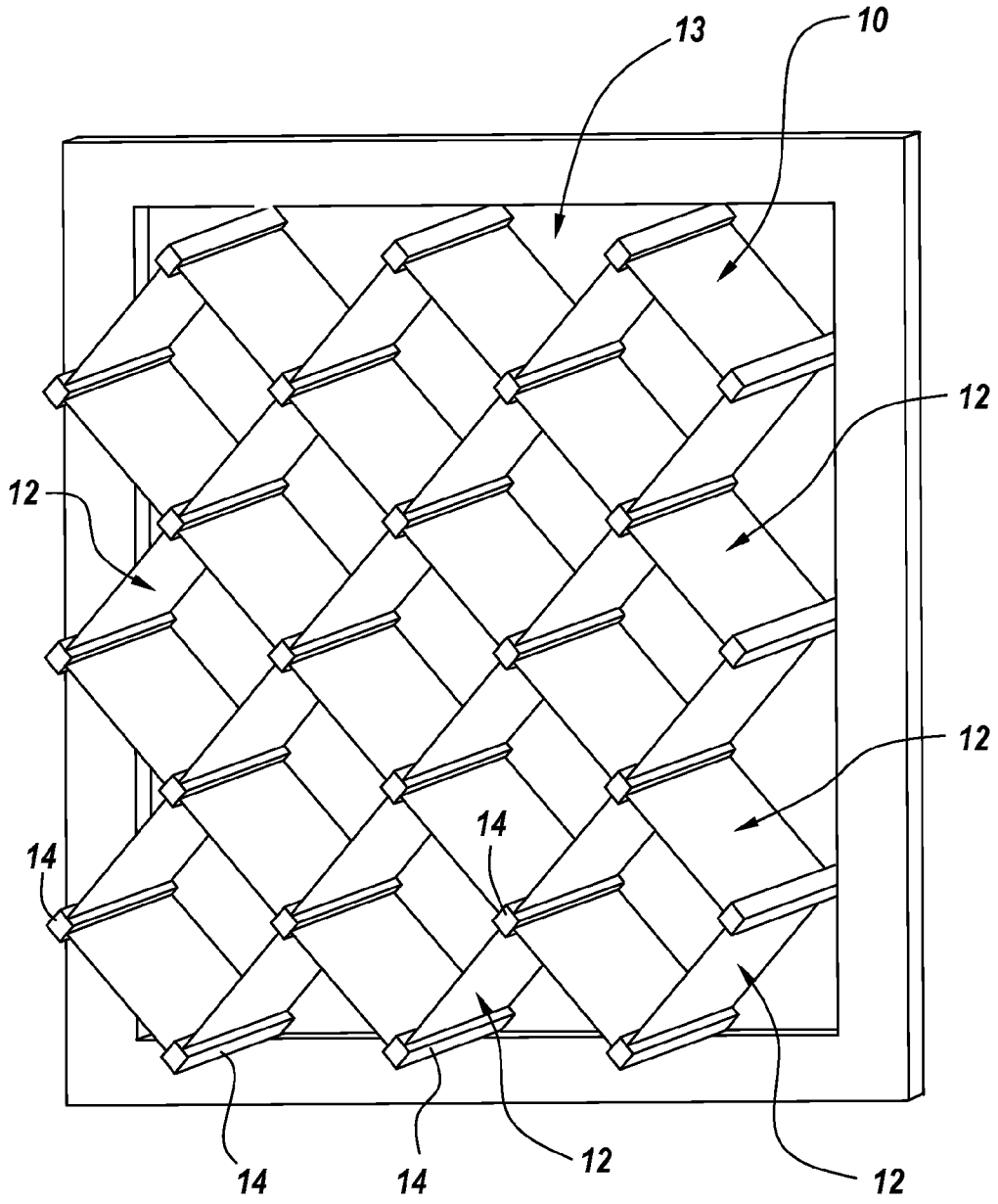
FIG. 1 is a diagrammatic illustration of an antenna array having elements patterned onto printed circuit cards, with the cards mounted in a diamond configuration utilizing slotted stanchions that are mounted to an antenna array support panel.

Referring now to FIG. 1, a planar antenna array 10 is composed a number of printed circuit card antenna elements 12 located in a diamond shaped pattern across an antenna array support panel 13, with antenna element printed circuit cards 12 being mounted between notched support columns 14 as illustrated.

One of the problems with the mounting of such an antenna array is to provide a support structure that has a relatively low radar cross section.

If, for instance the elements are mounted to a metalized support panel, for instance to provide a ground plane or the like for the antenna array, then the panel itself presents a relatively high radar cross section which is undesirable.

There is therefore a requirement to provide a suitable mounting system for antenna arrays, whether of the printed circuit card variety shown in FIG. 1 or individual elements extended up from a ground plane. It is the purpose of array support panel 13 to support the antenna array elements in the proper position along the array while at the same time minimizing the radar cross section.

Figure 2:
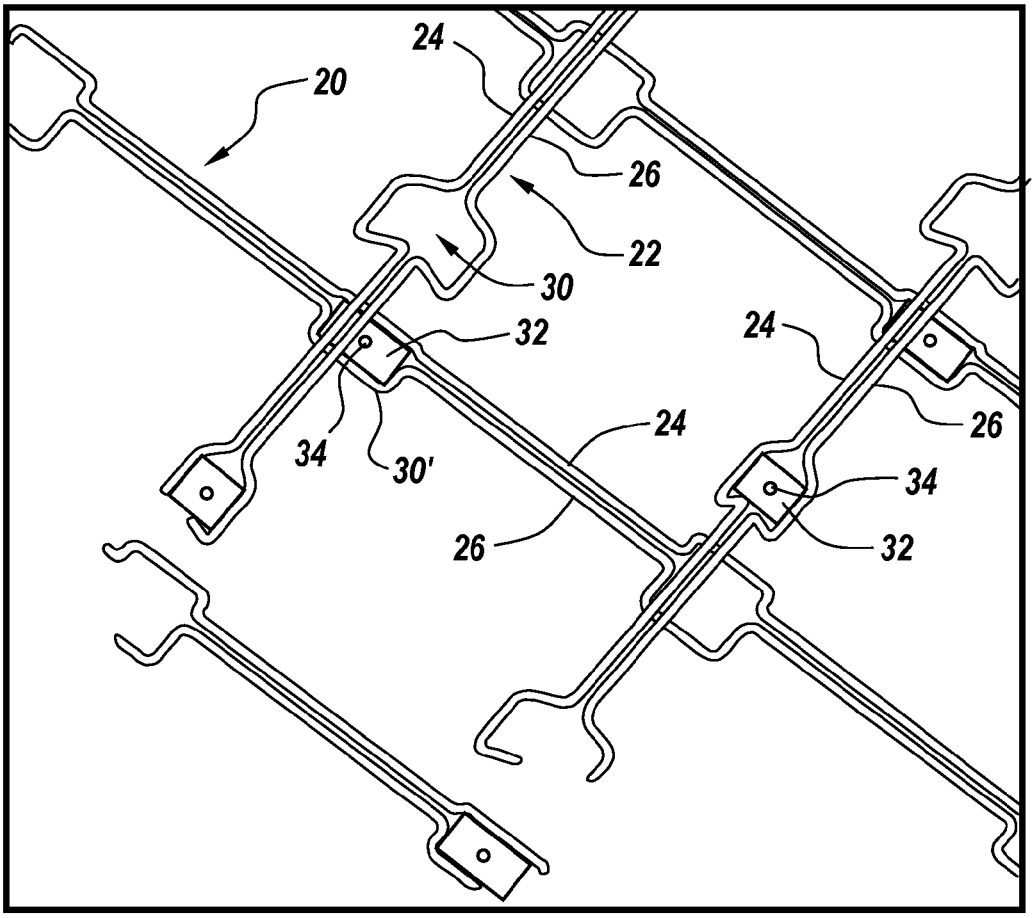
FIG. 2 is a diagrammatic illustration of a low radar cross section antenna array support panel useable for the antenna array of FIG. 1 showing non-interconnected overlying support segments made of side-by-side wire segments joined along the length thereof and having apertures adapted to surround and house support plates for mounting antenna elements.

Referring to FIG. 2, a low radar cross section antenna array support panel in one embodiment is made up of a lattice work or grid of overlying transverse segments 20 and 22 shown here unconnected. These overlying segments in one embodiment are composed of molded or performed wire pairs 24 and 26 that are separated at an aperture 30. Aperture 30 in one segment 22 is adapted to overlie an aperture 30' in an underlying crossed segment, here illustrated at 20, with a support plate 32 located within the aperture.

The subject array support panel is fabricated as a low RCS grid or lattice structure in which the segments may be located orthogonal one to the other and are cross linked at a junction aperture.

Note that the overlying apertures form cross linked segments and create a relief region for the periodic placement of the support plates. Here the support plate is illustrated with a central aperture or hole 34 adapted to accommodate a screw or bolt therethrough.

The array support panel lattice may be configured with the aforementioned apertures spaced apart at distances commensurate with the operating characteristics of the antenna to be mounted thereon, with the support plates securing the antenna elements for the formation of the antenna array.

Figure 3:
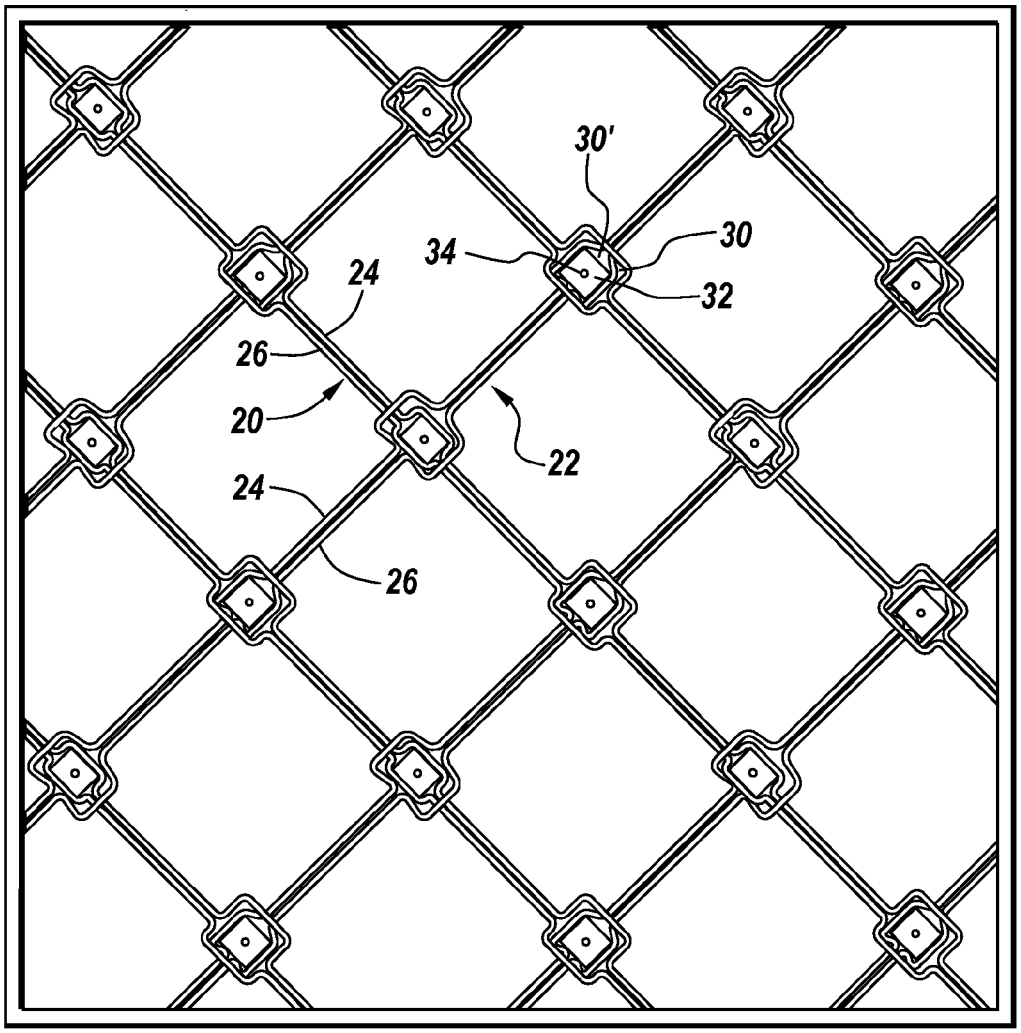
FIG. 3 is a diagrammatic illustration of the low RCS array support panel of FIG. 2 showing the assembly thereof in which preformed side-by-side wire segments are welded in mirror image pairs along the length thereof and have apertures that overlie corresponding apertures in an orthogonal underlying wire segment pair such that the support segments are connected at their junctions in a cross linked fashion that offers transverse support to the resulting grid or lattice.

The completed array support panel lattice or grid is shown in FIG. 3 in which apertures 30 and 30' are shown to include support plate 32 into hole 34 which is formed.

The overlying lattice work structure composed in one embodiment of orthogonal segments may be formed by welding the overlying structures together or in some other way bonding or connecting the overlying structures in a cross linking manner which may also involve interlocking features of the overlying segments.

While the subject array support panel is shown in one embodiment to incorporate mirror image wire pairs, the support structure may be made of plastic and spot welded to create the lattice type support structure, it being understood that in this particular embodiment there is no ground plane provided by the support structure.

It is noted that the support plates of FIGS. 2 and 3 may be spaced according to the frequency performance requirements defined for the antenna array being supported. It is also noted that the metallic elements of the support panel may be placed behind the active area of the antenna elements, with the area between the wire pairs that form the array grid left open to the antenna environment thus reducing the weight of the antenna array assembly while at the same time creating a support panel with little or no extra reflective surfaces. It is noted that it is the reduced reflectivity of the support panel that provides for the low radar cross section described above.

While the array support panel being of an open work lattice or grid may be used to support the printed circuit card antenna array elements shown in FIG. 1, it will be appreciated that the support plates may be utilized to support for instance vertically-upstanding antenna elements. Thus the subject array support panel is not limited to the mounting of printed circuit card antenna array elements.

Figure 4:
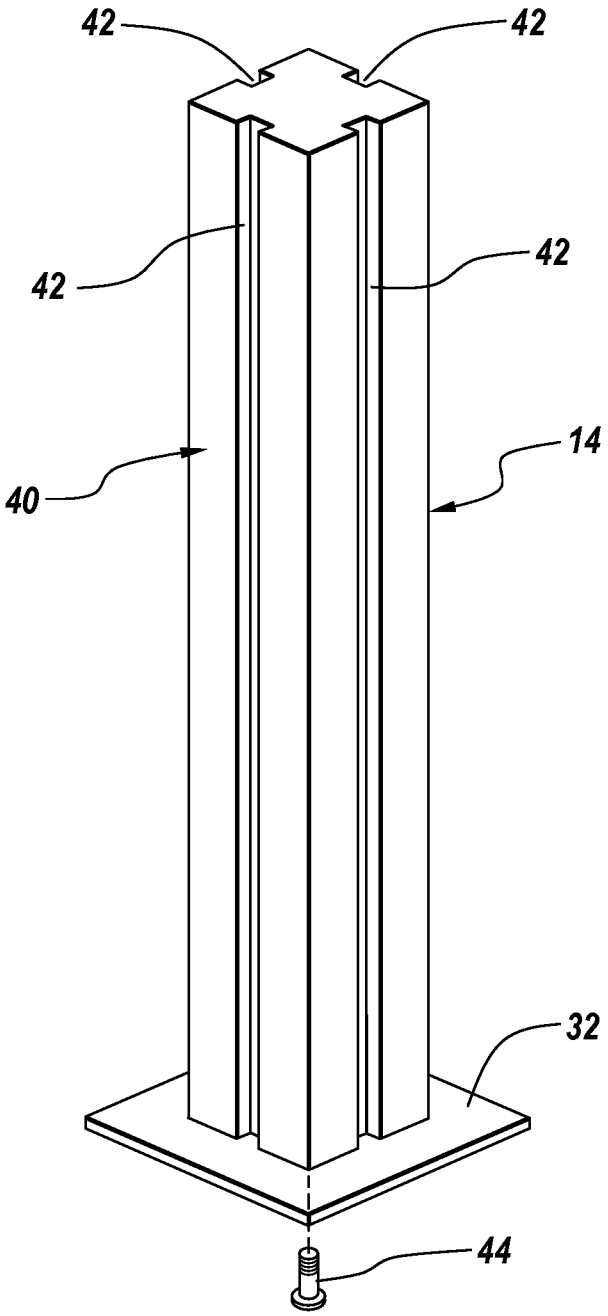
FIG. 4 is a diagrammatic illustration of a slotted column or stanchion utilized to support printed circuit card antenna elements.

More particularly and referring to FIG. 4, columns 14 of FIG. 1 may include a square cross-section member 40 having longitudinally running slots 42 on all four sides of the member.

It will be appreciated that this column is anchored to support plate 32 with a screw or bolt 36 that runs up through hole 34 in support plate 32.

Figure 5:
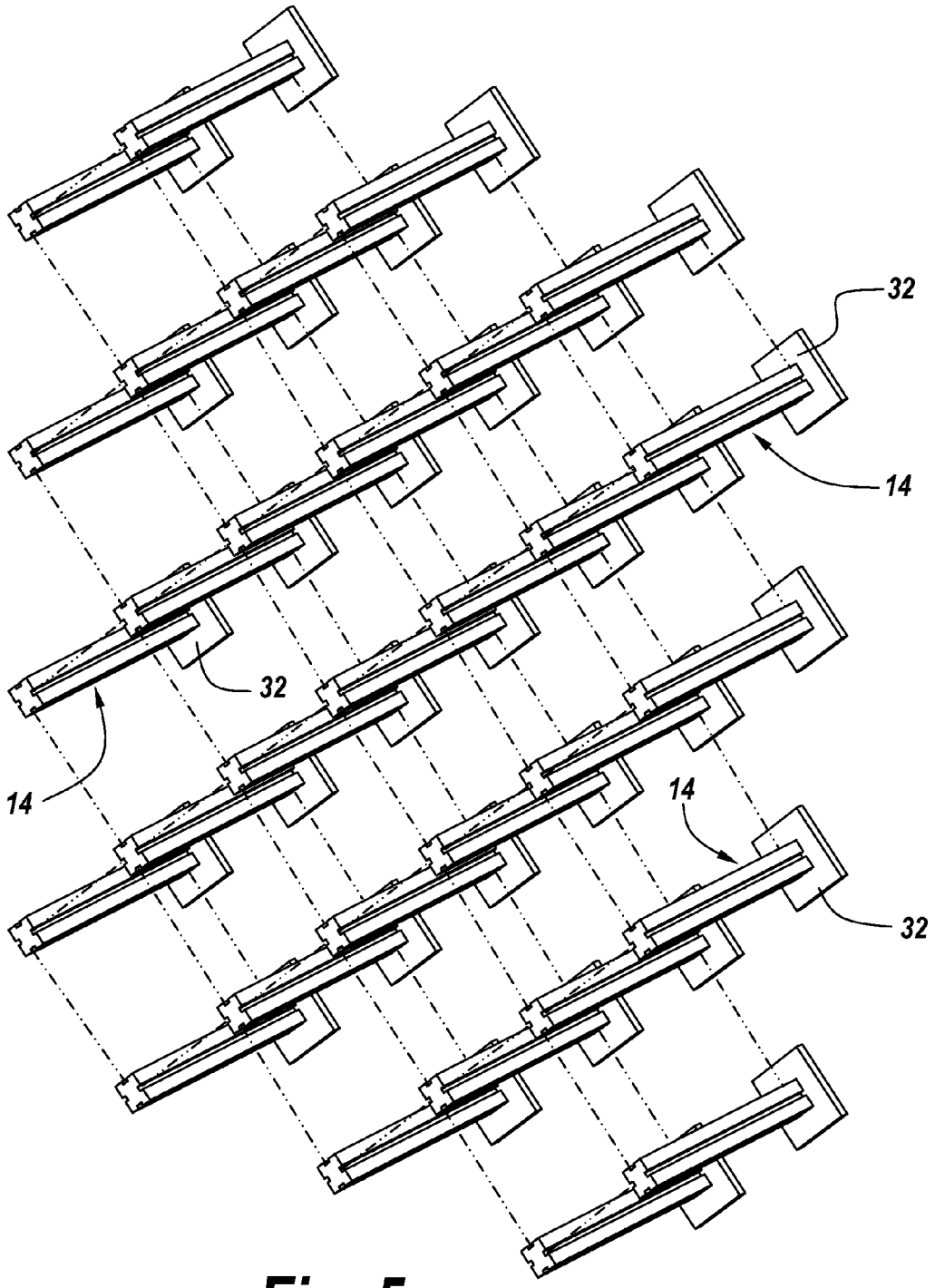
FIG. 5 is a diagrammatic illustration of the mounting of the columns or stanchions of FIG. 4 on the support plates supported at the junctions of the array support panel of FIG. 3; and, FIG. 6 is a diagrammatic illustration of the support of four slotted columns or stanchions on array support panel plates, showing printed circuit card antenna elements located within associated slots to provide an interlocking structure.

The construction of the printed circuit card antenna array element structure is shown in FIG. 5 in which numbers of support columns 14 are mounted on associated support plates 32, with the array support panel grid or lattice locating the columns in any one of a number of desired patterns to house the supported printed circuit cards. The arrangement of FIG. 5 shows an arrangement that would support the diamond shaped array of FIG. 1, but is shown for illustrative purposes only.

Figure 6:
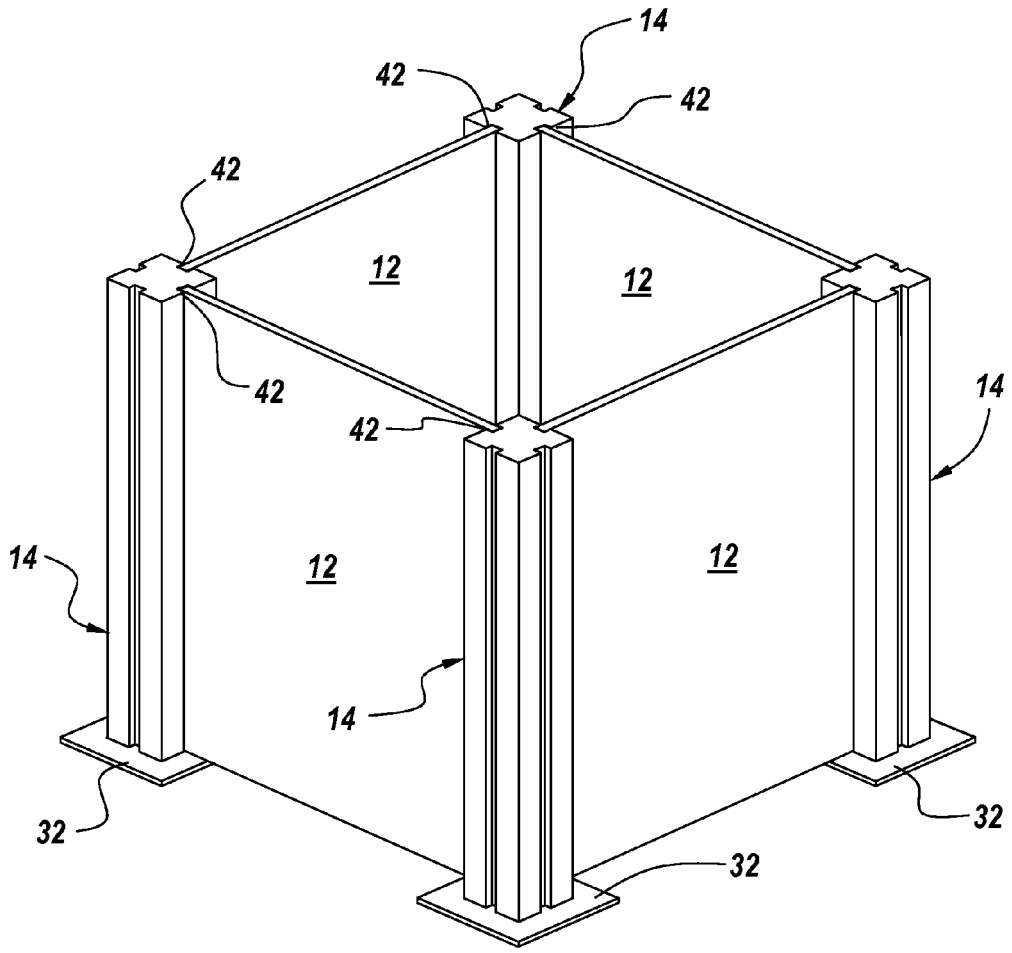

Referring to FIG. 6, what is shown are opposed columns 14 housing a printed circuit card therebetween. Here each of the columns are secured, screwed or bolted to the associated support plate 32. This provides a secure low radar cross section mounting system, with the crossovers of the lattice defining a predetermined pattern related to the operational frequency of the array.

While the present invention has been described in connection with a preferred embodiment, it is to be understood that other similar embodiments may be used or modifications and additions may be made to the described embodiment for performing the same function of the present invention without deviating therefrom. Therefore, the present invention should not be limited to any single embodiment.

What is claimed is:

1. An antenna support panel for rigidly supporting an antenna array which exhibits a low radar cross-section, comprising:

a plurality of separate and spaced apart rectilinear antenna elements, each carrying an antenna thereon;

a base supporting the plurality of separate and spaced apart rectilinear antenna elements, the base including a plurality of lattice configured wire formed support segments defining overlying apertures, wherein the base provides a low radar cross-section; and a plurality of spaced apart junctions, wherein an upstanding member, defining at least first and second slots, is positioned at each junction, wherein the first and second slots receive edges of neighboring antenna elements such that the neighboring antenna elements are relatively orthogonal but do not directly intersect.

2. The antenna support panel of claim 1, wherein the plurality of lattice configured wire formed support segments further comprises:

a first pair of wires extending in a first direction including a first wire segment and a second wire segment, wherein portions of the first and second wire segments are spaced apart defining a first aperture therebetween; and a second pair of wires extending in a second direction transverse the first direction including a third wire segment and a fourth wire segment, wherein portions of the third and fourth wire segments are spaced apart defining a second aperture therebetween;

wherein the first pair of wires lay above the second pair of wires and the first aperture is aligned directly over the second aperture.

3. The antenna support panel of claim 2, further comprising a plurality of support plates, wherein one support plate is disposed between the third and fourth wire segments in the second aperture, wherein at least one of the plurality of support plates is positioned beneath and supporting a corresponding upstanding portion.

4. The antenna support panel of claim 3, wherein each of the plurality of support plates defines a central fastener receiving hole, further comprising:

a fastener extending through the central fastener receiving hole and extending through the overlying apertures.

5. The antenna support panel of claim 1, wherein the first and second slots are at least equal in length to the edges on the antenna elements.

6. A method of supporting an antenna array so as to minimize the radar cross section of the array, comprising the steps of:

providing an open work lattice structure having wire formed support members defining overlying apertures crossing at junctions, and a support plate disposed within a lower one of the overlying apertures, each of the junctions having an upstanding member connected to the support plate with a fastener extending through the support plate and overlying apertures, said antenna array having a number of separate and spaced apart individual rectilinear freestanding antenna elements, and mounting at least one of the antenna elements of the antenna array to the open work lattice structure at the upstanding member associated with the junction, the open work lattice structure providing a minimal radar reflectivity mounting structure for the antenna array.

7. The method of claim 6, wherein the open work lattice structure includes metal support members, wherein each metal support member defines a single centrally aligned fastener receiving hole and the fastener extending through said hole.

8. The method of claim 7, further comprising the step of vertically aligning one antenna element with one of the wire formed support members.

9. The method of claim 8, further comprising the step of forming side-by-side pairs of the wire members to define lattice segments.

10. The method of claim 6, further comprising the step of anchoring opposed edges of printed circuit cards to the open work lattice structure at the upstanding members associated with opposed junctions.

11. The method of claim 10, and wherein the upstanding members include upstanding notched stanchions at the junctions, wherein the notches are equal length as edges of print circuit cards.

12. The method of claim 6, further comprising the step of positioning the junctions along a support member to optimize the frequency requirements of the antenna array.

13. The method of claim 6, wherein the support members of the lattice are configured to connect orthogonally at the junctions.

14. A base for supporting an antenna, the base comprising:

a first pair of wires extending in a first direction including a first wire segment and a second wire segment, wherein portions of the first and second wire segments are spaced apart defining a first aperture therebetween;

a second pair of wires extending in a second direction transverse the first direction including a third wire segment and a fourth wire segment, wherein portions of the third and fourth wire segments are spaced apart defining a second aperture therebetween;

wherein the first pair of wires lay over the second pair of wires and the first aperture is vertically aligned to above the second aperture; and wherein the first and second pairs of wires define an open work lattice structure exhibiting a low radar cross-section;

a support plate positioned in the second aperture between the third and fourth wire segments, wherein the first aperture overlies the support plate, and the support plate defines a fastener receiving hole adapted to receive a fastener extending therethrough and extending through the first aperture;

an upstanding support member defining a slot, the upstanding support member orthogonally connected to the support plate by a fastener extending through the fastener receiving hole and first aperture; and at least one antenna element of the antenna having an edge, wherein the slot is at least equal in length to the edge.

15. The base of claim 14, wherein the open work lattice structure has an opening that is partially defined by the first pair of wires and the second pair of wires, the lattice opening being larger than the wires thereby reducing radar cross section.

16. The base of claim 14, wherein space adjacent first and second pairs of wires is non-reflective.

* * * * *